US005338927A

United States Patent [19]

de Groot et al.

[11] Patent Number: 5,338,927

[45] Date of Patent: Aug. 16, 1994

[54] PROXIMITY FOCUSING IMAGE INTENSIFIER TUBE WITH SPACER SHIMS

[75] Inventors: Paul de Groot, St Ismier; Yves Beauvais, St Egreve, both of France

[73] Assignee: Thomson Tube Electroniques, Velizy, France

[21] Appl. No.: 10,781

[22] Filed: Jan. 29, 1993

[30] Foreign Application Priority Data

Jan. 31, 1992 [FR] France ..... 92 01090

[51] Int. Cl.[5] ..... H01J 40/14

[52] U.S. Cl. ..... 250/214 VT; 313/528

[58] Field of Search ..... 250/214 VT, 214 LA, 250/336.1, 370.09, 370.11; 313/528; 358/44

[56] References Cited

U.S. PATENT DOCUMENTS

| | | | |
|---|---|---|---|
| 4,070,578 | 1/1978 | Timothy et al. | 250/336.1 |
| 4,481,531 | 11/1984 | Warde et al. | 313/528 |
| 4,550,251 | 10/1985 | Zitelli et al. | 250/214 VT |
| 4,730,107 | 3/1988 | Enck, Jr. et al. | 250/214 VT |
| 5,161,008 | 11/1992 | Funk | 358/44 |

FOREIGN PATENT DOCUMENTS

| | | |
|---|---|---|
| 3704716 | 8/1988 | Fed. Rep. of Germany . |
| 9002961 | 3/1990 | World Int. Prop. O. . |

*Primary Examiner*—David C. Nelms
*Assistant Examiner*—K. Shami
*Attorney, Agent, or Firm*—Oblon, Spivak, McClelland, Maier & Neustadt

[57] ABSTRACT

The disclosure relates to image intensifier tubes of the proximity focusing type, wherein it especially concerns the positioning of a primary screen with respect to a slab of microchannels. An image intensifier tube comprises a sealed chamber containing a primary screen and a slab of microchannels. The slab of microchannels is fixed to the body of the chamber. According to one characteristic, the primary screen is fixed to the slab, from which it is kept at a distance by means of at least one insulating shim. The result thereof is greater precision and greater uniformity of the spacing between the primary screen and the slab of microchannels.

11 Claims, 2 Drawing Sheets

PROXIMITY FOCUSING IMAGE INTENSIFIER TUBE WITH SPACER SHIMS

BACKGROUND OF THE INVENTION

1. Field of the Invention

The invention relates to image intensifier tubes of the type wherein, firstly, an incident ionizing radiation is converted into photons in the visible or near-visible range and wherein, secondly, a slab comprising microchannels is used to ensure a gain in electrons.

2. Description of the Prior Art

Image intensifier tubes such as these are often called "proximity focusing" tubes. They are used, for example, in radiology. The principle of radiological image intensifier tubes ( IIR tubes in short ) using slabs of microchannels is well known. It is described notably by J. Adams in "Advances in Electronics and Electron Physics", volume 22A, pp. 139–153, Academic Press, 1966.

FIG. 1 gives a schematic view of the structure of a standard IIR tube using a slab of microchannels such as this.

The IIR tube 1 comprises a vacuum-tight chamber, constituted by a tube body 2 positioned about a longitudinal axis 13 of the tube. The body 2 is closed at one end by an input window 3 and at the other end by an output window 14.

The X-rays penetrate the IIR tube through the input window, which should be as transparent as possible to these rays: the input window 3 is generally constituted by a thin metal foil (aluminium, tantalum, etc.).

The X-rays then encounter a layer 4 of scintillating material in which they are absorbed and give rise to a local emission of light proportional to the quantity of X-radiation absorbed. The scintillator material may be, for example, caesium iodide forming the layer 4 with a thickness of the order of 0.1 to 0.8 nm. The layer 4 of scintillator material is supported by a single plate 5 transparent to X-rays, formed for example by a thin metal foil (for example made of aluminium alloy) or else a silica-based glass plate etc. The supporting plate 5 is located towards the input window.

The scintillator 4 bears a photocathode 6. The photocathode 6 is constituted by a very small thickness (often smaller than one micrometer) of a photo-emissive material. This layer is deposited on a face of the scintillator 4 that is opposite the supporting plate 5. The photocathode 6 absorbs the light emitted by the scintillator 4 and, in response, sends out electrons locally into the surrounding vacuum, in proportion to this light. The set constituted by the supporting plate 5 bearing the scintillator 4 which itself bears the photocathode 6 constitutes a primary screen 15.

The electrons (not shown ) emitted by the photocathode 6 are directed by an electrical field towards the input face 8 of a slab 7 of microchannels. To this effect, a first potential and a second potential V1, V2 are applied respectively to the photocathode 6 and to the input face 8, the second potential V2 being more positive than the first potential V1.

The slab 7 of microchannels is an assembly of a multitude of small parallel channels 12 assembled in the form of a rigid plate. Each primary electron (sent out by the photocathode) that penetrates a channel is multiplied by a phenomenon of secondary emission in cascade on the walls of the channel, so that the flow of electrons at the output of the slab can be more than a thousand times greater than the input flow. The diameter d1 of the channels may range from 10 to 100 micrometers. The channels 12 are inclined with respect to the normal to the plane of the slab so that the electrons which are emitted by the photocathode 6 in parallel to this normal cannot emerge from a channel without giving rise to a phenomenon of secondary emission. In order to reduce the number of electrons that strike the input face of the slab 7 outside the channels 12, it is the usual practice to make a widened portion 35 at the input to these channels and hence to reduce the thickness of their walls. The thickness E of the plate that forms the slab 7 of microchannels is typically between 1 and 5 mm. The electronic gain of the slab may be adjusted over a wide range of values, for example between 1 and 5000, as a function of the voltage developed between the input face 8 and an output face 9 of this slab 7, namely an output face 9 to which a third potential V3 is applied.

The electrons at output of the slab of microchannels are accelerated and focused by an electrical field, on a luminescent screen (10) positioned so as to be facing the slab, parallel to this slab, and at a distance D of the order of 1 to 5 mm. The luminescent screen 10 locally emits a quantity of light proportional to the incident electron current. The luminescent screen therefore restores a visible and intensified image of the X-ray image projected on the scintillator, through the input window of the tube. The luminescent screen, which is a layer with a thickness of some microns, constituted by grains of luminophor material, is deposited on a glass port which may constitute the output window 14 of the tube. The face of the luminescent screen 10, pointed towards the slab 7 of microchannels, is coated with a very thin metal layer 18, made of alumininum for example. The metallization enables the electrical polarization of the screen (by the application of a fourth potential V4 that is more positive than the third potential V3) and acts as a reflector for the light reflected rearwards by this screen. The port 14 supporting the screen 10 may be made of glass, or may be constituted for example by a fiber-optic system. The screen 10 may be deposited directly on this port or on an intermediate transparent support if it is desired to insulate the screen 10 from the port because of constraints of use.

The primary screen 15 and the slab 7 of microchannels are fixedly joined to the body 2 of the tube, for example by means of lugs 21, 22, 23 sealed to this body. To these lugs, there are furthermore applied the polarizing potentials V1, V2, V3. The polarizing of the input and output faces 8, 9 is furthermore ensured by means of a metallization (not shown) with which, as a rule, these input and output faces of the slab are generally coated except, naturally, in positions facing the channels 12. The primary screen 15 and the slab 7 are thus fixed so as to be electrically insulated from each other while, at the same time, being separated by a relatively small distance D1 of the order of some tens of millimeters (it must be noted that for greater clarity, FIG. 1 has not been drawn to scale).

These conditions are necessary to obtain, between the photocathode 6 and the input face 8 of the slab, an electrical field suited to the task of accelerating the electrons emitted by the photocathode 6 towards the input of the microchannels of the slab 7; this electrical field should be intense enough to limit the angular dispersion of the electrons which tends to reduce the spatial dispersion of the IIR tube.

Furthermore, the distance D1 between the photocathode 6 and the slab 7 should be maintained uniformly to obtain high image resolution on the entire field.

Under these conditions, the accurate positioning of the primary screen 15 and, especially, of the photocathode 6 with respect to the slab 7, is a lengthy and delicate operation that is made even more difficult by the low mechanical rigidity of the supporting plate 5 (bearing the scintillator 4) in order to absorb the X-radiation to the minimum extent.

An additional complexity is provided by a difference between the expansion coefficients of the scintillator 4 and of its support 5. The result of this difference is that the primary screen 15 structure tends to get deformed, and that it is difficult to limit this deformation to less than some tens of millimeters when it takes effect over lengths close to several centimenters. Furthermore, if the primary screen 15 is moved away from the slab 7 to minimize the influence of the deformations, the result is an unacceptable loss of resolution.

Now, what is sought is the industrial-scale manufacture of IIR tubes with proximity focusing, capable of picking up large-sized images as is the case with IIR tubes in which the image, formed on the output screen by the electrons emitted by the photocathode, results from a focusing of these electrons by means of an electronic optical device. In IIR tubes using electronic optical devices, the primary screen may commonly attain a diameter of up to about 50 centimeters.

It is clear that, with such dimensions, the positioning of a primary screen with respect to a slab of microchannels raises serious problems. At present, this constitutes one of the major drawbacks of IIR tubes with proximity focusing. However, this type of tube has advantages as compared with those using an electronic optical device. Thus, for example, this type of tube may be much flatter than the latter type of tube (with a smaller distance between the primary screen and the output screen); furthermore, it can be made more easily to receive and form a rectangular image.

SUMMARY OF THE INVENTION

The present invention relates to image intensifier tubes wherein there is used, firstly, a scintillator to convert an ionizing radiation into light radiation or radiation close to the visible range, and wherein there is used, secondly, a slab of microchannels positioned in the vicinity of the primary screen and, more specifically, in the vicinity of the photocathode. The invention is aimed at enabling a relative positioning that is precise and reliable between the primary screen and the slab of microchannels, with a very small distance which may be smaller than 0.2 millimeters.

To this end, the invention proposes to fixedly join the primary screen and the slab of microchannels, by means of electrically insulating shims. The number and distribution of these shims are chosen notably as a function of the surfaces that face each other, so as to obtain the most efficient compromise between mechanical rigidity and minimum absorption of the electrons emitted by the photocathode.

The invention therefore relates to an image intensifier tube comprising a primary screen, a slab of microchannels fixed in the intensifier tube, the primary screen comprising a scintillator borne by a supporting plate, a photocathode borne by the scintillator, the photocathode facing an input face of the slab, wherein the primary screen is fixedly to the slab by means of insulating shims.

BRIEF DESCRIPTION OF THE DRAWINGS

The invention will be understood more clearly from the following description of certain of its embodiments, made with reference to the appended drawings of which.

For greater clarity, FIGS. 1 to 4 have not been drawn to scale.

DETAILED DESCRIPTION OF THE INVENTION

Figure 1:
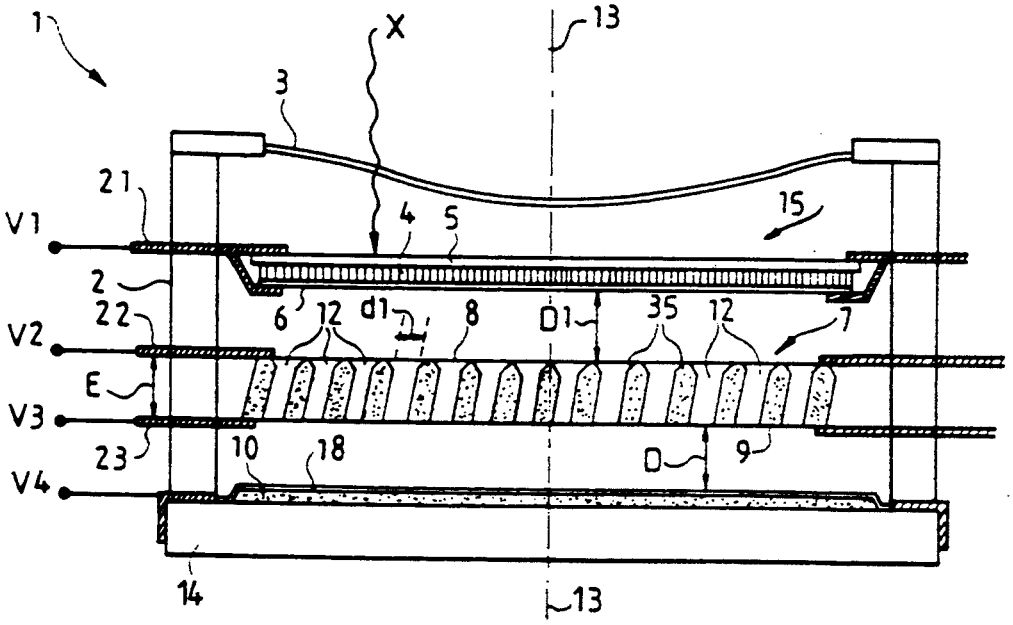
FIG. 1, already described, is a sectional view representing the structure of an IIR tube with proximity focusing according to the prior art.
Figure 2:
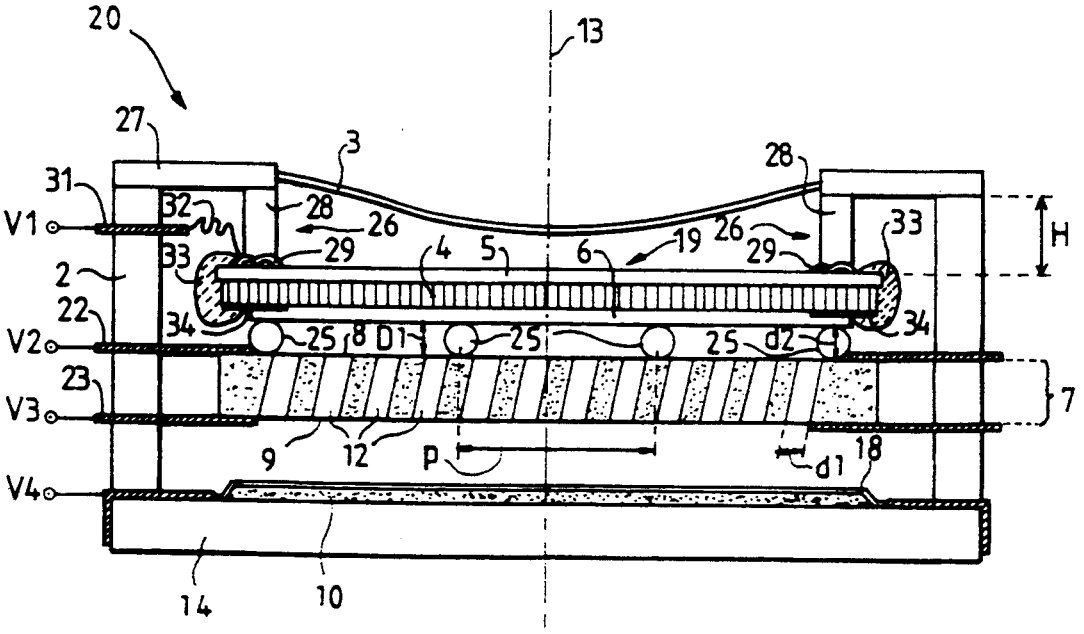
FIG. 2 is a sectional, schematic view of the structure of an IIR tube with proximity focusing, made according to a preferred embodiment of the invention.

FIG. 2 shows an IIR tube 20 according to the invention. The tube 20 has a general structure similar to that of the IIR tube shown in FIG. 1.

However, the tube 20 differs from the one shown in FIG. 1 essentially by the way in which its primary screen is fastened.

The tube 20 comprises a vacuum-tight chamber, constituted by a tube body 2 closed at one end by an input window 3 and at the other end by an output window 14. This chamber contains a primary screen 19 and a slab 7 of microchannels positioned between the primary screen 19 and the output window 3.

The primary screen 19 is formed by a thin foil or plate 5 acting as a support for a scintillator 4; the scintillator is constituted for example by a layer of caesium iodide. The supporting plate 5 is oriented towards the input window 3 and the scintillator 4 is oriented towards the slab 7 of microchannels. On a face oriented towards the slab 7, the scintillator 4 bears a fine layer of a photoemissive material forming a photocathode 6.

The slab 7 of microchannels is fixed into the body 2 of the tube by means of fixing lugs 22, 23 which, firstly, are sealed into the body 2 which they cross and, secondly, are soldered to the two opposite large faces 8,9 which respectively constitute the input face and the output face of the slab 7. The fastening lugs 22, 23 may thus serve, furthermore, to apply the potentials V2,V3 necessary for the operation of the slab 7 as .already explained here above.

According to one characteristic of the invention, the primary screen 19 rests on the input face 8 of the slab 7 of microchannels by means of one or more electrically insulating shims 25. The height of the shims 25 defines the spacing between the photocathode 6 and the input face 8 of the slab 7, i.e. the distance D1 between these elements.

In the non-restrictive example shown in FIG. 2, the shims 25 are glass beads having, for example, a diameter d2 of 100 micrometers which forms the height of the shims. Beads such as these are commonly available in the market with a small variation of diameters around the nominal value.

Since the slab 7 of microchannels is fixed to the body 2 of the tube, it constitutes the support of the primary screen 19 which is kept resting on this screen under the thrust force exerted by one or more thrustor elements 26.

The primary screen 19 is thus mechanically fixed to the slab 7 of microchannels, and not to the body 2 of the tube as is the case in the prior art.

The thrustor elements 26 may be constituted in different ways, notably as a function of the modes of manufacture proper to each IIR tube. In the non-restrictive example of the description, these pressure devices rest on an internal peripheral part 27 of the input window 3, this peripheral part being more massive than the central part which, for its part, must absorb the incident X-radiation to the least possible extent.

In the example shown in FIG. 2, these thrustor elements 26 comprise: a rigid spacer 28 and a spring washer 29. The spring washer 29 is placed on the supporting plate 5 (in a peripheral zone of this plate 5) and the spacer 28 is placed between the input window 3 and the spring washer 29. The spacers 28 have a height H that is suited to keeping the primary screen 19 applied to the shims 25 by means of the spring washers 29. Several thrustor elements such as these may be used, distributed about the primary screen 15.

The first potential V1 is brought to the tube 20 by a crossing or lead-through element 31, to be applied to the photocathode 6, without thereby setting up any rigid link between the body 2 and the primary screen 19. The electrical link between the lead-through element 31 and the photocathode may be set up in different ways through the use of means that are simple per se. In the non-restrictive example described, this is obtained, firstly, by connecting the lead-through element 31 to the spring washer 29, by a flexible conductive wire 32, the spring washer 29 being itself in contact with the supporting plate 5 bearing the scintillator (the supporting plate 5 is then preferably made of an electrically conductive material); furthermore, the spring washer 29 is electrically connected to the photocathode 6 through a conductive layer 33, and a metallization layer 34 made between the scintillator 4 and the photocathode 6 in a peripheral zone of the primary screen 19 (this metallization 24 clearly does not overlap the useful central surface of the primary screen).

The metallization 34 is made, for example, by vacuum evaporation of a thin layer (for example with a thickness of 0.1 to 1 micrometer) of chromium or aluminium or of another metal deposited on the periphery of the scintillator 4.

This metallization 34 is then covered partially by the photocathode, in such a way that the electrical connection with the photocathode is set up while, at the same time, the most peripheral part of the metallization 34 is kept clear. This most peripheral part of the metallization 34 is then covered with the conductive layer 33 which is also in contact with the supporting plate 5 and the spring washer or washers 29, and also with the edge of the scintillator 4. In fact, the conductive layer 33 may cover the entire perimeter of the primary screen 19, i.e. the edge of this primary screen, the edge on which it can be deposited simply: for example, it may be result from the application, by means of a brush, of a paste containing metal granules. Suspensions of silver granules enabling a use such as this are commonly available in the market.

In the exemplary embodiment shown in FIG. 2, where the shims 25 are constituted by beads, these beads may be fixedly joined to the input face 8 of the slab 7 of microchannels by bonding. The bonder used may be a photosetting or thermosetting bonder and may be compatible, in its set condition, with use under vacuum. The bonder used for this purpose may be, for example, the one known as Araldite, the polymerization of which is accelerated by heating.

The beads or shims 25 are distributed and fixed to the input face 8 in a pitch p in the range of 2 centimeters for example. This can be accomplished in a simple way, for example by the deposition, on the input face 8 of the slab, of the spots of bonder with a spacing pitch p of two centimeters. Once the spots of bonder are deposited, the input face 8 of the slab are covered with a layer of glass beads and then the bonder is made to set by insolation or by heating. The glass beads are then eliminated except for those that have been in contact with a spot of bonder and have been consequently fixed to the slab 7 by these spots of bonder. The laying of these spots of bonder can be done by hand, or by means of automatic laying machines that are standard per se.

Since the beads 25 are fixedly joined to the slab 7, said slab is fixed mechanically into the tube by means of standard techniques.

The primary screen 19 is then placed in the slab 7 and fixed to this slab as explained further above through the application of pressure, at regular intervals, on the small glass beads or shims 25. Clearly, the primary screen 19 can itself be made in a conventional way.

The diameter of the beads may be chosen as a function of the desired image resolution: it should be small enough for the beads not to be visible in the image. The pitch p of the beads is matched to the deformability of the primary screen 19, i.e. the greater the deformability, the smaller is this pitch.

To obtain a situation where the photocathode 6 rests more evenly on the shims 25, it is also possible to give the primary screen a slightly non-plane shape, notably a concave shape (as seen from the input window 3) before it is fixed to the slab 7.

Figure 3:
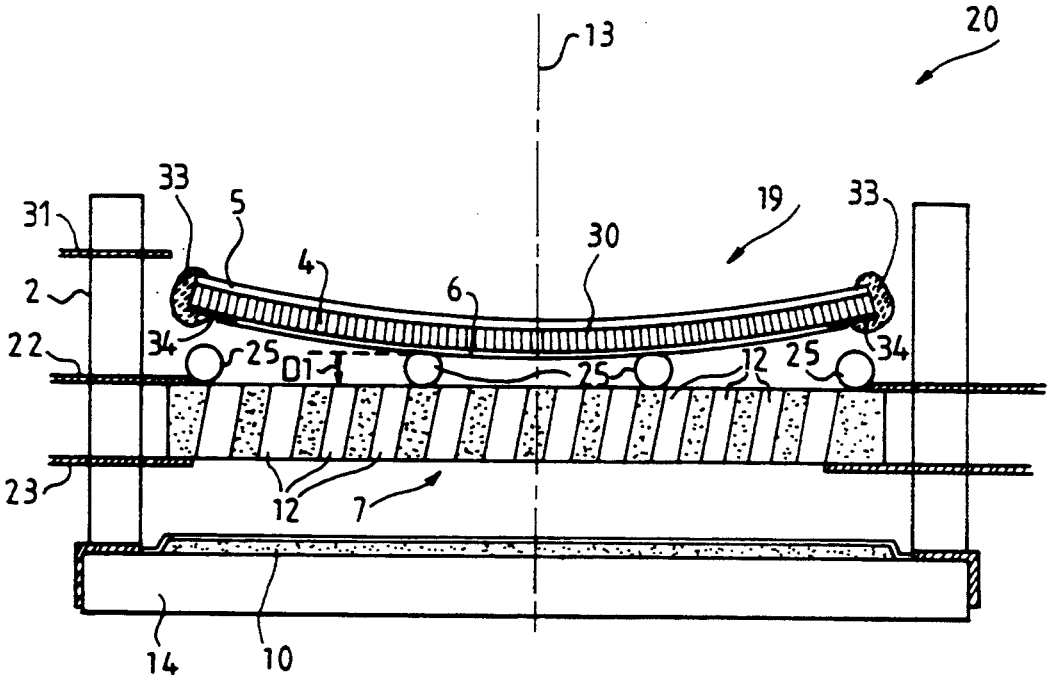
FIG. 3 is a sectional view illustrating the way in which a primary screen shown in FIG. 2 can be made.

FIG. 3 is a sectional view similar to that of FIG. 2, showing the primary screen 19 before it is fixed to the slab 7 of microchannels.

The primary screen 19 has a slightly concave shape such that, when it is placed above the slab 7 before being fastened to said slab 7, it is first of all by its central zone 30 that it is in contact with the shims 25. By then providing for regular pressure on the periphery 36 of the primary screen 19, when it is being fixed, by means of thrustor elements 26 (shown in FIG. 2), a uniform pressure of the primary screen on the shims 25 is obtained, by bringing the elasticity of the primary screen and, especially, of the supporting plate 5 into play.

A shape such as this, notably a concave shape, of the primary screen 15 may result from an internal mechanical tension of the primary screen 19. This mechanical tension may itself result from the concave shape initially given to the supporting plate or support 5 before the deposition of the scintillator 4 on this support. The coefficient of expansion of caesium iodide is generally higher than that of the support, and this scintillator is deposited hot on this support. As a result, the tension exerted by the scintillator 4 tends to reduce the initial concavity, and the support 5 should be given a concavity slightly greater than the one that is finally necessary. It is possible, for example, to give an initial deflection that is close to one millimeter for a support 5 made of an aluminium alloy with a 0.5 millimeter thickness and a diameter of 15 to 25 centimeters.

By thus fixing the primary screen 19 to the slab 7, the uniformity of the spacing between this slab 7 and the photocathode 6 depends to a greater extent on the diameters of the beads that constitute the shims 25 than on the mechanical rigidity of the support or supporting plate 5. Consequently, the thickness of the supporting plate 5 may be reduced so as to absorb the incident radiation to a smaller extent.

It must be noted that, by giving a concave shape such as this to the primary screen 19, resulting from an internal mechanical tension as explained here above, it is possible not only to obtain the most efficient fastening of the primary screen but also to restrict or even cancel the mechanical deformations of this primary screen, during operation, caused by differences between the heat expansion coefficient of the scintillator 4 and that of its support 5. This can be obtained, of course, on condition that the prior mechanical tension, on the one hand, and the cases of heat expansion, on the other, cause deformations in opposite directions.

Figure 4:
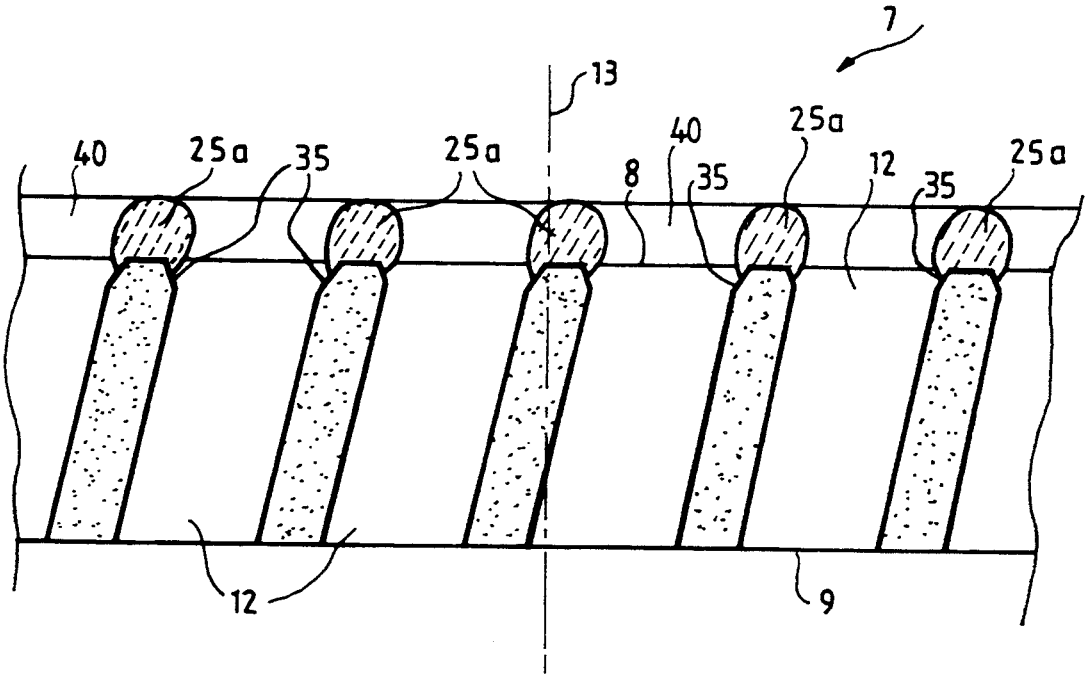
FIG. 4 is a sectional schematic view of another embodiment of insulating shims shown in FIG. 2.

FIG. 4 gives a schematic view of another way of making the insulating shims 25 which separate the photocathode 6 from the slab 7 of microchannels.

FIG. 4 shows a partial view of the slab 7 of microchannels in a sectional view that is similar to that of FIG. 3, but is enlarged with respect to this figure. In this other version, these insulating shims (referenced 25*a*) are constituted by a deposit or deposits of electrically insulating material, these deposits being formed by one or more layers 40 deposited on the input face 8 of the slab 7, between the inputs of certain channels 12 or all of them. These deposits or shims 25*a* should preferably (but not imperatively) obstruct the channels 12 to the least possible extent.

The deposits 25*a* can be obtained, for example, by a vacuum evaporation type of method for the deposition of an insulating material such as silica $SiO_2$, alumina $A1_2O_3$ 0 or any other material compatible with techniques using vacuums and photocathodes. The insulator material may be evaporated at an incidence that is highly oblique with respect to the surface of the slab, so as not to overlap the wall of the channels 12 in depth. The use of microchannels with a widened input 35 limits the surface area made available for the deposition of the insulator, and thus limits the obstruction of these channels 12. The penetration of the insulator material into the channels may be limited to the depth of the widened portion 35.

With a method such as this, it is possible to deposit a single layer 40 of insulating material on the input face 8 of the slab 7. This input face is pierced in the part facing each channel 12. However, it is also possible to make several localized deposits that do not constitute a single interrupted layer.

After the shims 25*a* are made, the slab 7 is fixed into the tube and the primary screen 19 is fixed to the slab 7 in a manner similar to that explained here above with reference to FIGS. 2 and 3. Naturally, this embodiment of insulating shims is applicable also when the primary screen 19 comprises an internal mechanical tension that gives it a concave shape.

What is claimed is:

1. An image intensifier tube for converting input radiation to amplified light output, said tube comprising a primary screen and a slab of microchannels wherein said slab has a central region and an outer region, the primary screen comprising a scintillator borne by a supporting plate and photocathode borne by the scintillator, the photocathode facing an input face of the slab of microchannels, wherein the primary screen is fixedly joined to the slab of microchannels by at least one insulator shim located in said central region of said slab of microchannels.

2. An intensifier tube according to claim 1, wherein the insulating shim or shims are fixed to the input face of the slab of microchannels.

3. An intensifier tube according to claim 1, wherein the insulating shims are fixed by bonded shims.

4. An intensifier tube according to claim wherein the insulating shims are beads.

5. An intensifier tube according to claim 4, wherein the beads have a nominal diameter that is greater than the diameter of the microchannels.

6. An intensifier tube according to claim 1, wherein the insulator shims are constituted by at least one layer of insulating material deposited on the input face of the slab of microchannels.

7. An intensifier tube according to claim 6, wherein the layer is a vacuum evaporation layer.

8. An image intensifier tube according to claim 1, wherein an input of the microchannels of the slab comprises a widening on the input face.

9. An image intensifier tube according to claim 8, wherein a layer of insulating material covers the walls of the microchannels on a depth at most limited to the widening.

10. An image intensifier tube according to claim 1, wherein the primary screen is fixed to the slab of microchannels through means to exert a thrust on the primary screen, on the periphery of said primary screen.

11. An image intensifier tube according to any of the above claims, wherein the primary screen, before being fixedly joined to the slab of microchannels, has a concave shape.

* * * * *